United States Patent [19]

Smith

[11] 4,327,897

[45] May 4, 1982

[54] CABLE GUIDE FOR POWERED WINCH

[75] Inventor: Roger R. Smith, Imlay City, Mich.

[73] Assignee: The United States of America as represented by the Secretary of the Army, Washington, D.C.

[21] Appl. No.: 134,860

[22] Filed: Mar. 28, 1980

[51] Int. Cl.[3] ..... B66D 3/08

[52] U.S. Cl. ..... 254/395; 254/406

[58] Field of Search ..... 254/327, 325, 396, 395, 254/394, 398, 402, 406, 400; 242/86.5 R, 86.51

[56] References Cited

U.S. PATENT DOCUMENTS

| | | | |
|---|---|---|---|
| 16,992 | 4/1857 | Osgood | 254/395 |
| 2,555,059 | 5/1951 | Schrader | 254/406 |
| 2,919,110 | 12/1959 | Magee | 254/395 |
| 2,946,559 | 7/1960 | Pickett | 254/395 |
| 4,127,295 | 11/1978 | Robinson | 254/327 |

*Primary Examiner*—Billy S. Taylor

*Attorney, Agent, or Firm*—Peter A. Taucher; John E. McRae; Nathan Edelberg

[57] ABSTRACT

In a military vehicle having a powered winch, the improvement comprising a cable guide that includes three rollers having concave edge surfaces guidably engaged with segmental surface areas of the cable. One of the rollers is carried by an auxiliary frame that can be swung away from its normal position to thread or unthread the cable. The three rollers are equi-spaced around the cable guide space so that normal cable loads are borne by at least two of the rollers.

2 Claims, 7 Drawing Figures

CABLE GUIDE FOR POWERED WINCH

BACKGROUND AND SUMMARY OF THE INVENTION

This invention relates to a guide mechanism for a cable adapted to be unwound from a powered winding drum or winch in a truck or similar vehicle. The cable guide mechanism is mountable on the front bumper of the vehicle forwardly of the powered winch or drum to provide roller guide surfaces approximately 18 inches from the drum axis. As the cable winds or unwinds relative to the drum its approach angle to the cable guide mechanism changes; the guide mechanism rollers have concave peripheral edges adapted to engage the cable surface around substantially its entire periphery so that changes in approach angle of the cable have minimal disturbing effect on the rollers.

The cable guide mechanism of my invention is advantageous in that loads on the rollers are applied to at least two of the rollers, whereby roller loadings are more effectively absorbed or handled. The load-absorbing capability of my roller design is obtained in a structure that permits rapid threading or unthreading of the cable through the guide mechanism without disconnecting the chain-hook assembly that is commonly provided at the free end of the cable. In the preferred embodiment of my invention there are three rollers arranged respectively at the 12 o'clock, 4 o'clock and 8 o'clock positions relative to the cable axis. The roller at the 12 o'clock position is carried on an auxiliary frame that is adapted to be swung to a position wherein the roller is spaced away from the cable axis, thus permitting the cable to be inserted or removed relative to the guide mechanism without disconnecting the chain-hook assembly.

The invention described herein may be manufactured, used and licensed by or for the Government for governmental purposes without payment to me of any royalty thereon.

IN THE DRAWINGS

Figure 7:
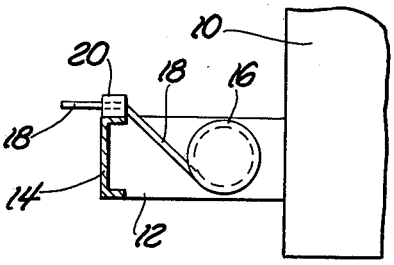
FIG. 7 is a schematic view illustrating a preferred location of my cable guide on a conventional military vehicle.

Referring to FIG. 7 in greater detail, there is fragmentarily shown a military vehicle that includes a hood 10, a pair of forwardly extending brackets 12, a front bumper 14, and a conventional powered winch or drum 16 having a multi-strand cable 18 extending therefrom through a cable guide 20 mounted on the upper edge of bumper 14. The non-illustrated free end of the cable is connected to a heavy chain that terminates in a hook. The cable usually has a diameter of approximately ½ inch, and the chain links are usually on the order of two inches in width.

In use of the cable-winch system the chain may be wrapped around the frame of a disabled vehicle and secured by the hook; the winding drum 16 is then powered or rotated to draw the other vehicle loose. The cable-winch system can also be used on the disabled vehicle itself, as by first wrapping the chain-hook assembly around a tree or other anchorage that happens to be in the vicinity. During non-use periods the cable can be wound completely onto the drum, and the chain wrapped or stowed around the vehicle brackets 12; in some cases it is desirable to unthread cable 18 from the guide mechanism 20 to effect stowage of the chain. My cable guide mechanism, as shown in FIG. 1–6, can be actuated to permit a cable-insertion or cable-removal operation without disconnecting the chain from the cable.

Figure 1:
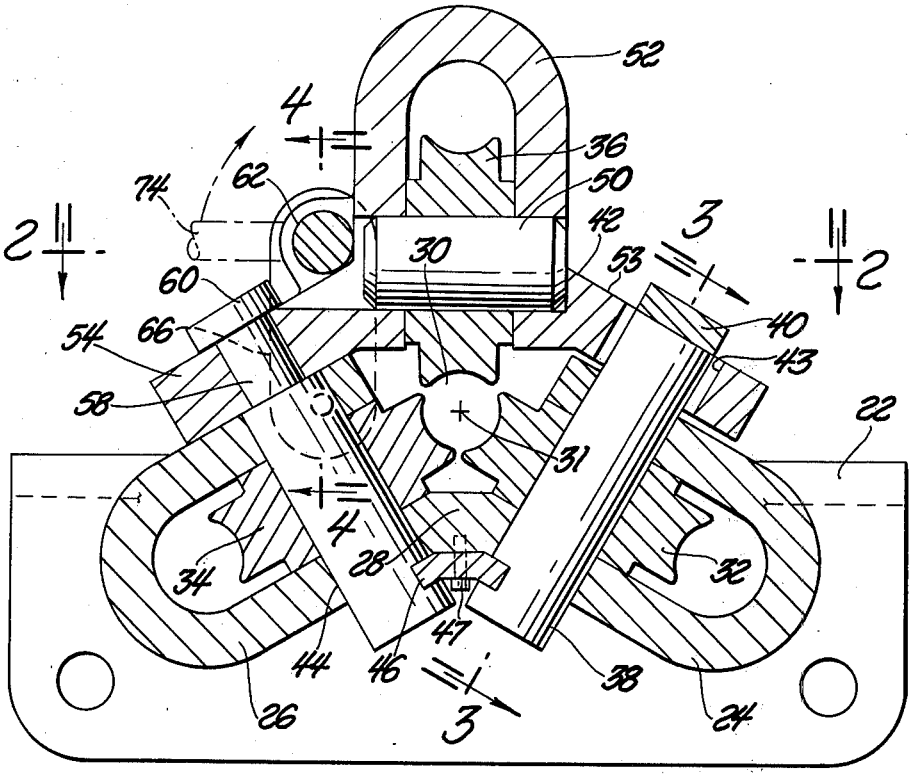
FIG. 1 is a sectional view taken through preferred embodiment of my invention.
Figure 2:
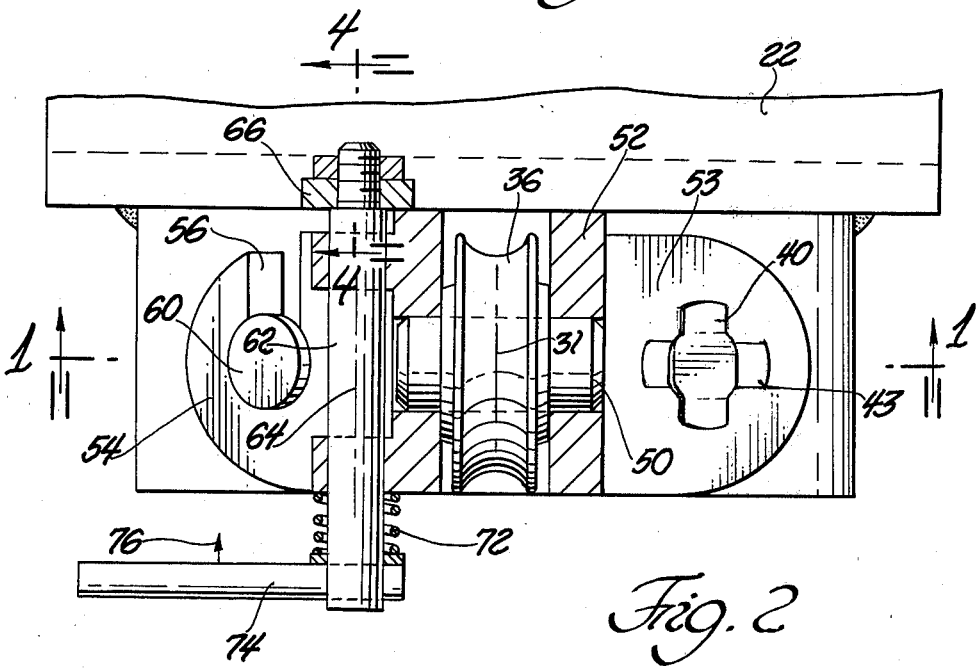
FIG. 2 is a sectional view taken on line 2—2 in FIG. 1.

As shown in FIGS. 1 and 2 the cable guide includes a main frame that comprises an angle iron base 22 adapted to be boltled onto the vehicle bumper; base 22 carries two U-shaped walls 24 and 26 that are connected by a central wall 28 directly below a circular cable guide space 30 (FIG. 1). Space 30 is defined by the concave peripheral edges of three equi-spaced rollers 32, 34 and 36. Roller 32 is freely rotatable on a fixed pin 38 that extends through the opposed wall areas of U-shaped wall 24. Roller 34 is freely rotatable on a fixed pin 44 that extends through the opposed wall areas of U-shaped wall 26. Pins 38 and 44 may be secured in place by a small V-shaped plate 46 having its lateral edges engaged in slots pre-formed in the pins; a bolt 47 may be used to secure plate 46 on the undersurface of wall 28. The assembly, comprising base 22 and U-shaped walls 24 and 26, constitutes a main frame for mounting rollers 32 and 34.

The third roller 36 is rotatably mounted on a pin 50 extending through a U-shaped wall 52 that forms part of an auxiliary frame 42. Frame 42 includes a wall section 53 that underlies head 40 on fixed pin 38. Frame 42 also includes a wall section 54 having a slot 56 extending forwardly from its rear edge to partially encircle section 58 of fixed pin 44. Pin 44 is provided with an enlarged head 60 that overlies wall 54 to prevent the auxiliary frame from upward displacement away from the cable guide axis 31.

Figure 3:
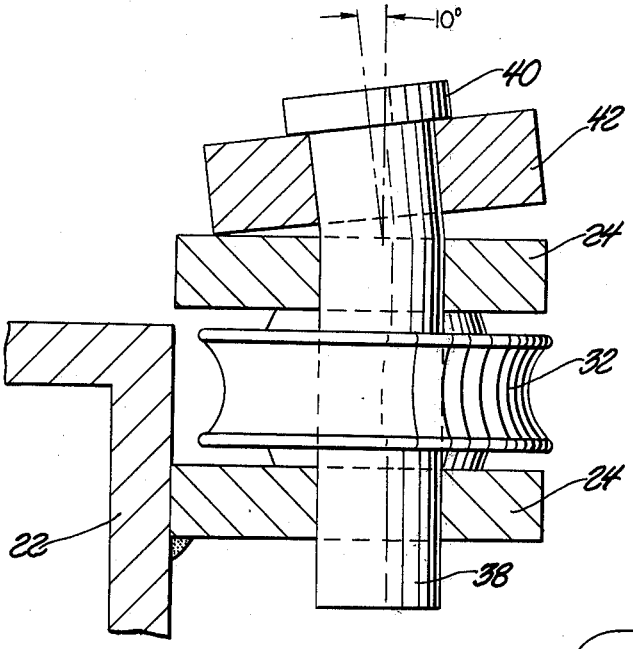
FIG. 3 is a sectional view taken on line 3—3 in FIG. 1.

FIGS. 1 and 2 illustrate the normal position of the three guide rollers 32, 34 and 36, wherein roller 32 occupies the 4 o'clock position relative to the cable guide axis 31, roller 34 occupies the 8 o'clock position relative to the cable guide axis, and roller 36 occupies the 12 o'clock position relative to the cable guide axis. The cable can be inserted into or removed from the cable guide space 30 after the auxiliary frame 42 is swung around pin 38 approximately 90° to the FIG. 5 position. The pivot axis for this swinging motion is provided by an upper section of pin 38 bent at an angle of approximately 10° to the main section of the pin; FIG. 3 best illustrates this feature. The purpose in thus bending pin 38 is to cause the auxiliary frame 42 to move in a plane that is slightly inclined in a rear-to-front direction, whereby the edge areas of roller 36 (FIG. 1) will clear the cable surface as frame 42 is swung between its FIG. 1 normal position and its FIG. 5 cable-insertion position. Wall section 53 of frame 42 is provided with a non-circular opening 43 that mates with the non-circular head 40 on pin 38 when frame 42 reaches the FIG. 5 position. This permits frame 42 to be completely removed from the main frame if so desired.

Figure 4:
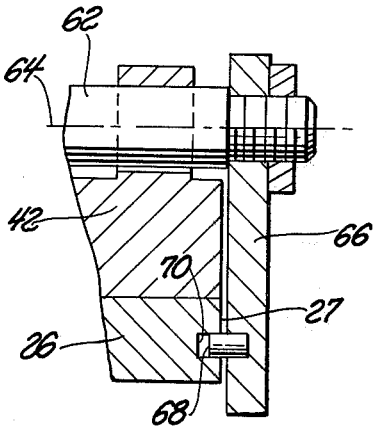
FIG. 4 is a sectional view on line 4—4 in FIG. 1.

The auxiliary frame is normally prevented from forward swinging motion by a movable latech that comprises a shaft 62 mounted on frame 42 for pivotal motion around an axis 64 that extends parallel to cable guide axis 31 and normal to pin 50. At its rear end shaft 64 carries a downwardly-extending detent plate or arm 66 whose face normally contacts the side surface 27 of main frame wall 26 (FIG. 4). The detent plate carries a lug 68 that normally sits in a socket 70 in the surface of frame wall 26, thereby preventing detent 66 from being swung upwardly around shaft axis 64.

Shaft 62 is capable of axial motion against the bias of a compression spring 72 positioned between auxiliary frame 42 and a handle 74 carried by shaft 62. Handle 74 can be pushed in the arrow 76 direction, FIG. 2, to disengage lug 68 from socket 70, after which the handle can be turned in a clockwise direction (FIG. 1) to rotate detent 66 to a position out of registry with frame wall 26. The auxiliary frame 42 can then be swung to the FIG. 5 position, using handle 74 as a pulling mechanism. The auxiliary frame can be returned to its FIG. 1 position by reversing the sequence of motions.

Figure 6:
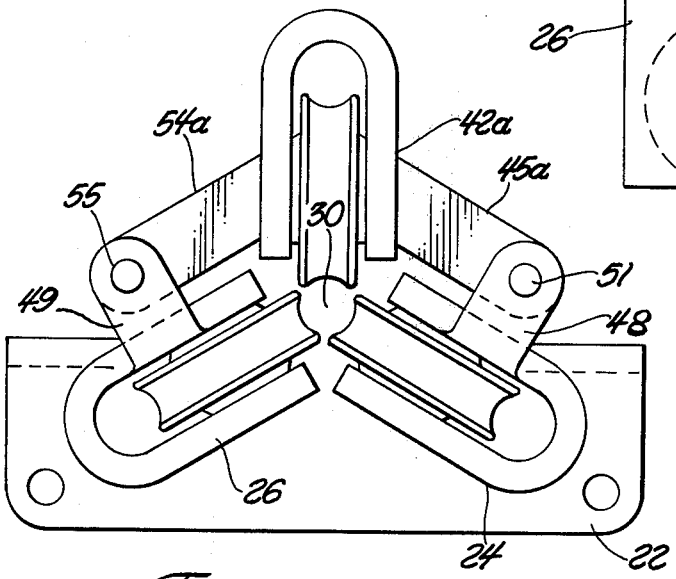
FIG. 6 is a front elevational view of another mechanism embodying my invention.
Figure 5:
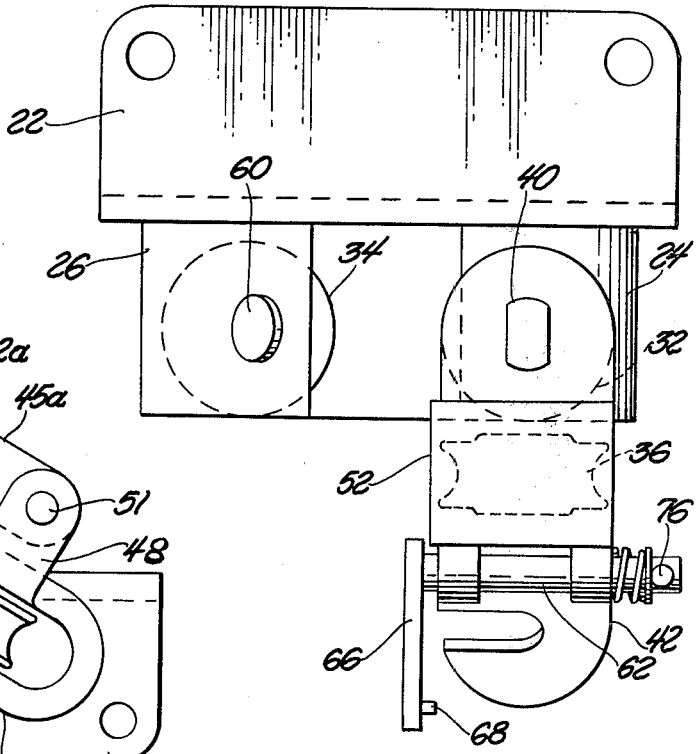
FIG. 5 is a top plan view of the FIG. 1 mechanism taken with an auxiliary frame swung away from the main frame to cable-insertion position.

FIG. 6 illustrates a second embodiment of the invention wherein the auxiliary frame **42*a* includes two sets of plate-like arms 45*a* and 54*a* adapted to overlap arms 48 and 49 that extend upwardly from the U-shaped walls 24 and 26 of the main frame 22. A pivot pin 51 extends through the overlapped arms 45*a* and 48 to form a pivot for the auxiliary frame 42*a*. A latch pin 55 is extendable through aligned openings in the overlapped arms 49 and 54*a* to normally retain frame 42*a* in its latched or normal position. After removal or retraction of latch pin 55 the auxiliary frame 42*a* can be swung upwardly around pivot shaft 51 to enable the cable to be inserted into or removed from the central guide space 30**.

My invention is advantageous in that rollers 32 and 34 act together in supporting the primary load imposed by the cable. As can be visualized from FIG. 7, the tension force on the cable 18 tends to displace the rollers 32 and 34 downwardly. Both rollers resist this tendency together so that no one roller is required to absorb the entire load. My invention is also advantageous in that the cable can be inserted into the guide mechanism or removed therefrom with a minimum of time and effort; the entire sequence of motions required to swing frame 42 to its FIG. 5 position can be accomplished by manual forces exerted on handle 74, without the use of auxiliary tools or implements.

I wish it to be understood that I do not desire to be limited to the exact details of construction shown and described for obvious modifications will occur to a person skilled in the art.

I claim:

1. In a vehicle having a powered winch-cable mechanism, the improvement comprising a cable guide: said cable guide comprising a main frame adapted for mounting on the vehicle bumper; first and second upstanding pins (38, 44) carried by the main frame in acutely angled relation to each other; first and second cable guide rollers rotatably encircling respective ones of the pins; said first pin including a main section passing through the associated roller and an auxiliary section bent at an angle of approximately ten degrees to the main section; an auxiliary frame swingably mounted on the auxiliary section of the first pin for swinging movement therearound; said auxiliary frame having a first normal position overlying the main frame and a second cable-insertion position swung away from the main frame; a third pin carried by the auxiliary frame; a third cable guide roller rotatably encircling said third pin; said rollers having concave peripheral edges adapted to guidably engage segmental surface areas of a cable whose axis is at the intersection of the roller rotational planes, said rollers having their respective rotational planes radiating from the cable axis; said third roller being mounted in the auxiliary frame at a twelve o'clock position directly above the cable axis, said first and second rollers being mounted in the main frame at the four o'clock and eight o'clock positions relative to the cable axis; and movable latch means operable to releasably retain the auxiliary frame in its normal position wherein the third roller is in its twelve o'clock position; said auxiliary frame being swingable around the auxiliary section of the first pin (38) to its cableinsertion position; the bent section of the first pin being oriented so that when the auxiliary frame is moving from its normal position it takes a slightly inclined path such that edge areas of the third roller will clear the cable surface.

2. The improvement of claim 1 wherein said latch means comprises a shaft (62) rotatably mounted on the auxiliary frame for pivotal motion around the shaft axis and normal to the axis of the aforementioned third pin, a detent (66) carried by said shaft for normally contacting a side surface of the main frame to thus prevent the auxiliary frame from being swung away from its first normal position; a handle (74) carried by the shaft for manual rotation of said shaft and swinging motion of the detent out of registry with the surface of the main frame; a lug (68) carried by the detent for engagement in a socket in the surface of the main frame to normally prevent swinging motion of the detent out of registry with the main frame; said shaft being capable of motion along its axis to thus shift the lug out of the socket; and a compression spring operable to bias the shaft in the axial direction that will cause the lug to seat in the socket.

* * * * *